US006840516B1

(12) United States Patent
Tien

(10) Patent No.: US 6,840,516 B1
(45) Date of Patent: Jan. 11, 2005

(54) HOCKEY PLAYING TABLE DEVICE

(76) Inventor: Feng-Yi Tien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/620,977

(22) Filed: Jul. 14, 2003

(51) Int. Cl.[7] ..... A63F 7/07
(52) U.S. Cl. ..... 273/126 A
(58) Field of Search ..... 273/108.1, 126 R, 273/126 A

(56) References Cited

U.S. PATENT DOCUMENTS 3,156,467 A * 11/1964 Rucker ..... 273/126 R
3,887,187 A * 6/1975 Crossman et al. ..... 273/126 A
4,548,409 A * 10/1985 Cacho ..... 273/126 R
5,104,607 A * 4/1992 Driska ..... 264/536
5,382,022 A * 1/1995 Cook et al. ..... 273/126 R
2001/0033054 A1 * 10/2001 Rossi et al. ..... 273/126 R

* cited by examiner

*Primary Examiner*—Raleigh W. Chiu

(57) ABSTRACT

A hockey playing table device has a main table, a score counter disposed on the main table, a plurality of pedestals connected to the main table, a pair of goals disposed on the main table, a pair of hitting control devices connected to the main table, and a plurality of hockey disks placed on an upper face of the main table. A plurality of blocking plates are disposed on an edge of the upper face of the main table. A periphery panel encloses an outer periphery of the main table. A rail frame is disposed on the periphery panel to cover the blocking plates. Each of the blocking plates has a threaded hole and a plurality of through holes.

4 Claims, 4 Drawing Sheets

HOCKEY PLAYING TABLE DEVICE

BACKGROUND OF THE INVENTION

The present invention relates to a hockey playing table device. More particularly, the present invention relates to a hockey playing table device which simulates a real hockey playing field in order to provide a sound while a hockey disk hits a blocking plate.

A conventional hockey playing table device has a main table, a score counter disposed on the main table, a plurality of pedestals connected to the main table, a first contacting frame surrounding an upper periphery of the main table, a second contacting frame surrounding the first contacting frame, and a CPU (central processing unit) connected to a horn, the first contacting frame and the second contacting frame electrically. When a hockey disk hits the first contacting frame, the first contacting frame will contact the second contacting frame. Then a short circuit will occur. Therefore, a signal will be sent to the CPU and the CPU sends another signal to the horn in order to produce a loud sound. If the hockey disk hits the first contacting frame strongly, the first contacting frame will be connected to the second contacting frame, and the loud sound will be produced for a long period of time. Furthermore, it is difficult to assemble the CPU, the horn, the first contacting frame and the second contacting frame electrically.

SUMMARY OF THE INVENTION

An object of the present invention is to provide a hockey playing table device which has a plurality of blocking plates and each of the blocking plates has various number of through holes in order to produce various sound while at least a hockey disk hits the blocking plates.

Another object of the present invention is to provide a hockey playing table device which has a plurality of blocking plates, a plurality of echo tubes, and each of the echo tubes disposed beneath the corresponding blocking plate in order to echo and amplify various sound while at least a hockey disk hits the blocking plates.

Accordingly, a hockey playing table device comprises a main table, a score counter disposed on the main table, a plurality of pedestals connected to the main table, a pair of goals disposed on the main table, a pair of hitting control devices connected to the main table, and a plurality of hockey disks placed on an upper face of the main table. A plurality of blocking plates are disposed on an edge of the upper face of the main table. A periphery panel encloses an outer periphery of the main table. A rail frame is disposed on the periphery panel to cover the blocking plates. Each of the blocking plates has a thread d hole. Each of the blocking plates has various number of through holes.

DETAILED DESCRIPTION OF THE INVENTION

Figure 1:
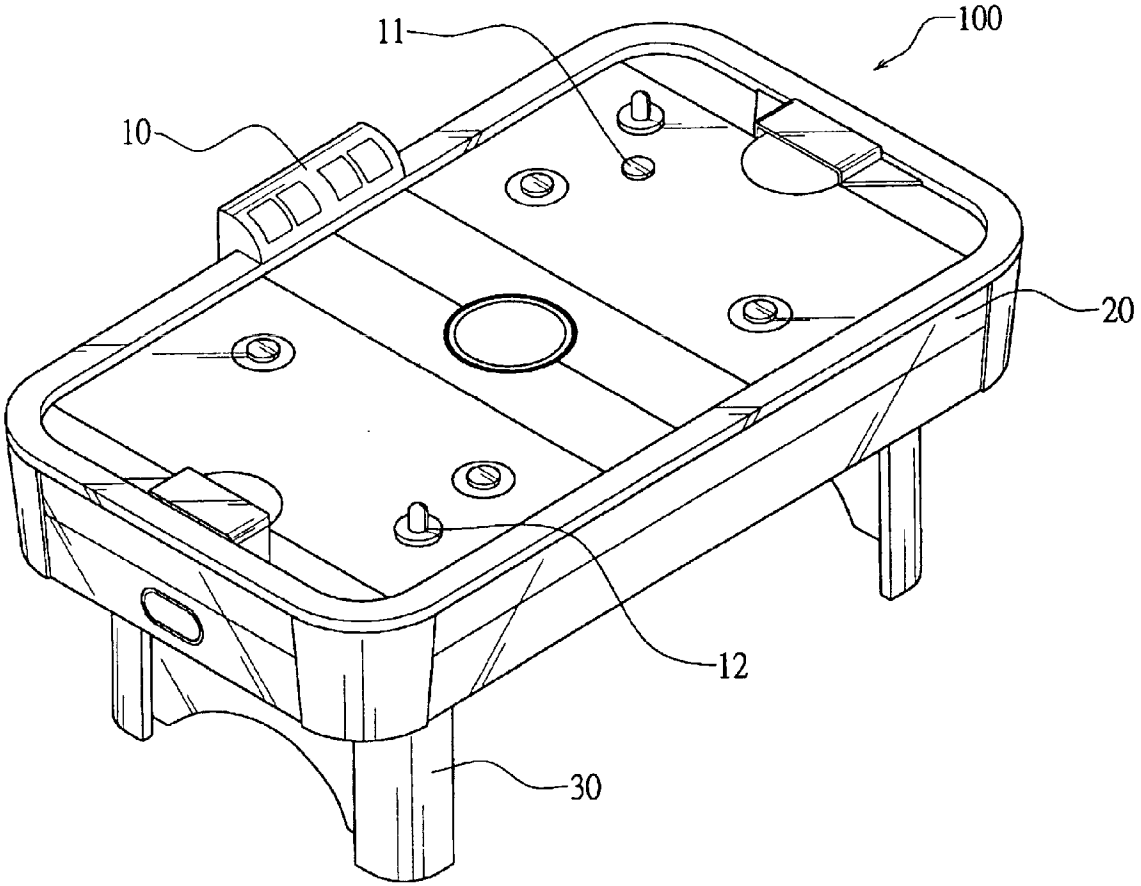
FIG. 1 is a perspective view of a hockey playing table device of a preferred embodiment in accordance with the present invention.
Figures 2, 2A:
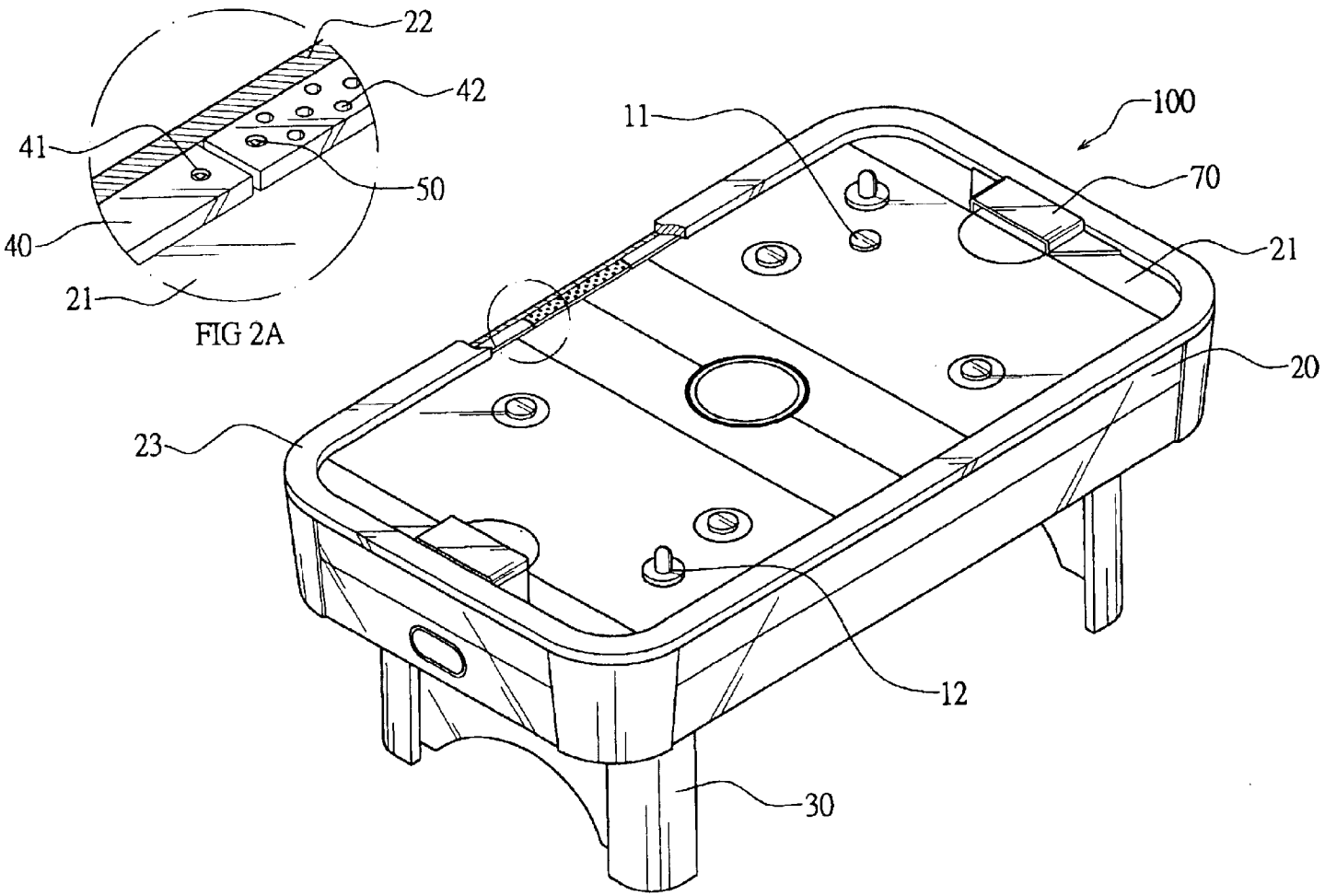
FIG. 2 is a perspective and partially sectional view of a hockey playing table device of a preferred embodiment in accordance with the present invention.
FIG. 2A is a partially perspective view of two blocking plates of a preferred embodiment in accordance with the present invention.
Figure 3:
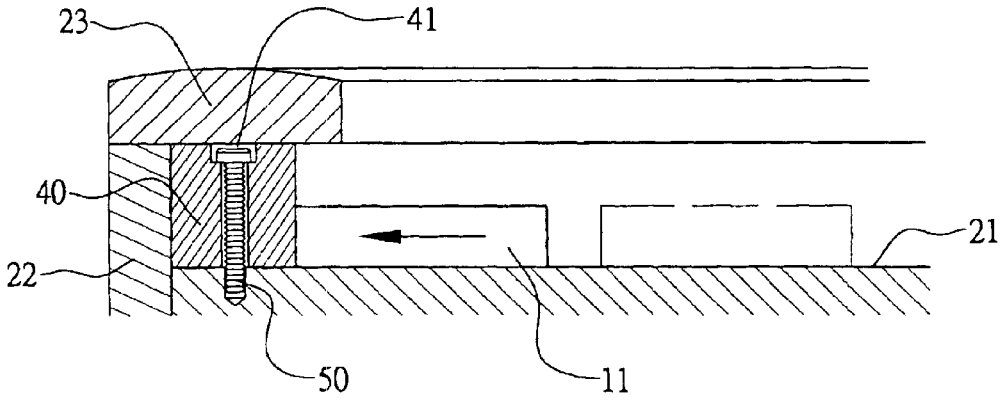
FIG. 3 is a partially sectional view of a hockey playing table device of a preferred embodiment in accordance with the present invention.

Referring to FIGS. 1 to 3, a hockey playing table device 100 comprises a main table 20, a score counter 10 disposed on the main table 20, a plurality of pedestals 30 connected to the main table 20, a pair of goals 70 disposed on the main table 20, a pair of hitting control devices 12 connected to the main table 20, and a plurality of hockey disks 11 placed on an upper face 21 of the main table 20.

A plurality of blocking plates 40 are disposed on an edge of the upper face 21 of the main table 20.

A periphery panel 22 encloses an outer periphery of the main table 20.

A rail frame 23 is disposed on the periphery panel 22 to cover the blocking plates 40.

Each of the blocking plates 40 has a threaded hole 41 to receive a bolt 50.

Each of the blocking plates 40 has various number of through holes 42 in order to produce various sound while at least one hockey disk 11 hits the blocking plates 40.

It is an option to provide the blocking plates 40 with various lengths.

It is an option to replace the blocking plates 40 with metal tubes or nonmetal tubes.

Figure 4:
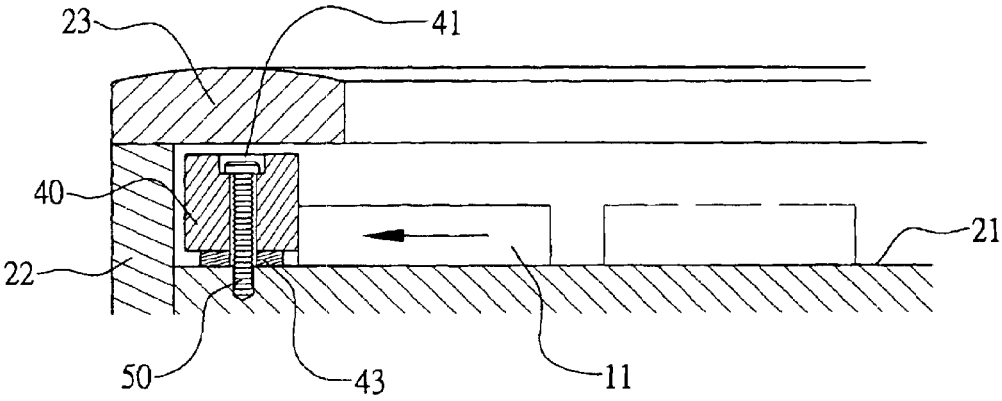
FIG. 4 is a sectional schematic view illustrating a pad disposed beneath a blocking plate of a preferred embodiment in accordance with the present invention.

Referring to FIG. 4, an additional pad 43 is disposed between one of the blocking plates 40 and the upper face 21 of the main table 20. When one hockey disk 11 hits the blocking plate 40, the sound will be clear.

Figure 5:
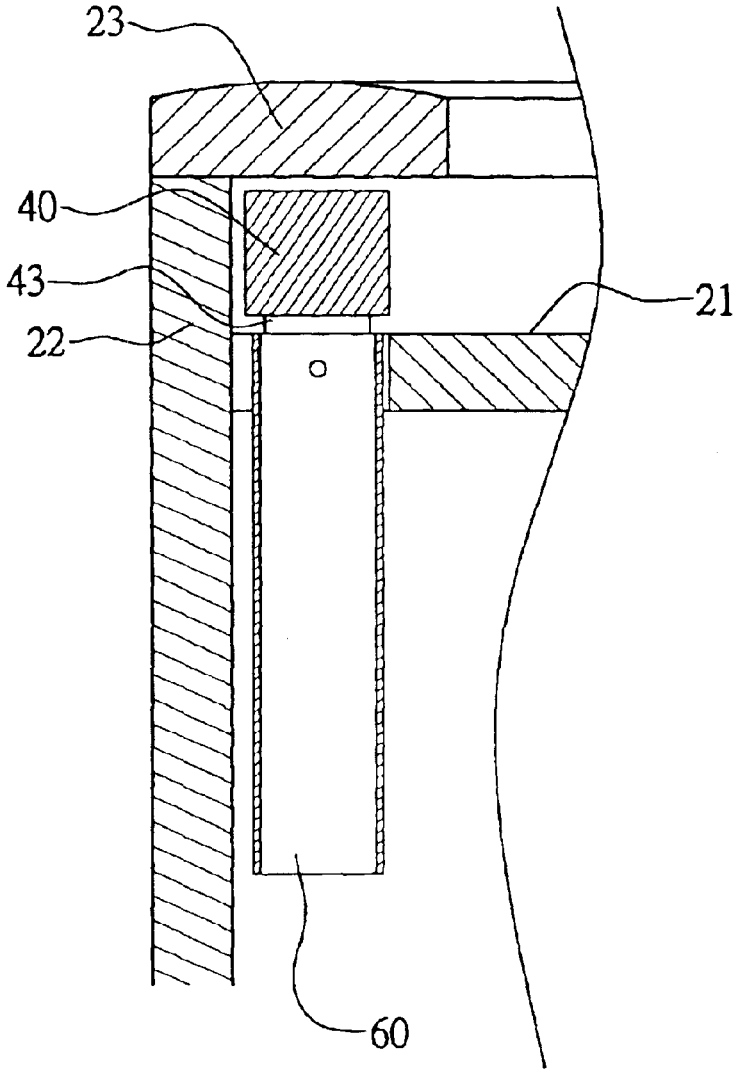
FIG. 5 is a sectional schematic view illustrating an echo tube disposed beneath a pad and the pad disposed beneath a blocking plate of a preferred embodiment in accordance with the present invention.

Referring to FIG. 5, an additional echo tube 60 is disposed beneath the pad 43 and inserted in the main table 20.

It is an option to replace the echo tube 60 with a sound amplifying device such as a loudspeaker.

The invention is not limited to the above embodiment but various modification thereof may be made. Further, various changes in form and detail may be made without departing from the scope of the invention.

I claim:

1. A hockey playing table device comprises:

a main table, a score counter disposed on the main table, a plurality of pedestals connected to the main table, a pair of goals disposed on the main table, a pair of hitting control devices connected to the main table, a plurality of hockey disks placed on an upper face of the main table, a plurality of blocking plates disposed on an edge of the upper face of the main table, a pad disposed between one of the blocking plates and the upper face of the main table, a periphery panel enclosing an outer periphery of the main table, a rail frame disposed on of the periphery panel to cover the blocking plates, each of the blocking plates having a threaded hole to receive a bolt, and each of the blocking plates having various of through holes.

2. The hockey playing table device as claimed in claim 1, wherein an echo tube is disposed beneath the pad and inserted in the main table.

3. The hockey playing table device as claimed in claim 1, wherein a sound amplifying device is disposed beneath the pad.

4. The hockey playing table device as claimed in claim 3, wherein the sound amplifying device is a loudspeaker.

* * * * *